US005513153A

United States Patent [19]

Thorgersen et al.

[11] Patent Number: 5,513,153

[45] Date of Patent: Apr. 30, 1996

[54] METHOD OF MANUFACTURING THREE-DIMENSIONAL INDICIA ON ELECTROLUMINESCENT TIMEPIECE DIALS AND TIMEPIECE DIALS PRODUCED THEREBY

[75] Inventors: Harold Thorgersen; Jose Santana, both of Woodbury, Conn.

[73] Assignee: Timex Corporation, Middlebury, Conn.

[21] Appl. No.: 387,693

[22] Filed: Feb. 13, 1995

[51] Int. Cl.[6] ..... G04B 19/30

[52] U.S. Cl. ..... 368/227; 445/23; 29/896.32; 368/226; 368/232

[58] Field of Search ..... 29/177; 445/24, 445/23; 368/226, 227, 228, 232

[56] References Cited

U.S. PATENT DOCUMENTS

| | | | |
|---|---|---|---|
| 1,607,822 | 11/1926 | Granger | 101/170 |
| 2,252,647 | 8/1941 | Schmitz | 368/294 |
| 3,054,175 | 9/1962 | Spreter | 29/527 |
| 3,162,748 | 12/1964 | Vogt | 219/117 |
| 3,197,846 | 8/1965 | Vogt | 29/177 |
| 3,206,841 | 9/1965 | Vogt | 29/177 |
| 3,251,124 | 5/1966 | Vogt | 29/177 |
| 3,277,562 | 10/1966 | Huguenin | 29/177 |
| 3,287,798 | 11/1966 | Beyeler et al. | 29/177 |
| 3,769,676 | 11/1973 | Feller | 29/177 |
| 3,798,730 | 3/1974 | Morf | 29/177 |
| 3,851,460 | 12/1974 | Piquerez | 368/296 |
| 3,989,603 | 11/1976 | Montavon | 29/177 X |
| 4,702,616 | 10/1987 | Kizawa | 368/76 |
| 4,775,964 | 10/1988 | Alessio et al. | 368/226 X |
| 4,916,798 | 4/1990 | Ballast | 29/432 |
| 5,265,071 | 11/1993 | Thorgersen et al. | 368/226 X |
| 5,346,718 | 9/1994 | Thorgersen et al. | 368/226 X |

*Primary Examiner*—Kenneth J. Ramsey

*Attorney, Agent, or Firm*—William C. Crutcher; David H. Hwang

[57] ABSTRACT

The method of manufacturing electroluminescent timepiece dials having three-dimensional indicia and to timepiece dials produced by this method. A subdial having the indicia projecting therefrom is affixed to the bottom of the electroluminescent dial. Three-dimensional effect is created when the projecting indicia are received by apertures in the electroluminescent dial.

9 Claims, 1 Drawing Sheet

METHOD OF MANUFACTURING THREE-DIMENSIONAL INDICIA ON ELECTROLUMINESCENT TIMEPIECE DIALS AND TIMEPIECE DIALS PRODUCED THEREBY

This invention relates to a method of manufacturing electroluminescent timepiece dials having three-dimensional indicia and to timepiece dials produced by this method.

Timepiece dials having three-dimensional indicia and methods for producing them are well known. For example, it has been proposed to attach indicia, such as hour numerals or markers, onto timepiece dials by soldering or utilizing adhesives. The problem with soldering is that the heat required for soldering often spoils the finish of adjacent portions of the dial. Moreover, soldering is not applicable when the finish of the dial includes a coat of varnish. As for an adhesive, it is not sufficiently dependable as an attaching means. In addition, an adhesive poses a problem because portions of the adhesive are often extruded around the edges of the indicia.

Another method for manufacturing timepiece dials having three-dimensional indicia involves stamping a plate of metal, such as aluminum, to produce indicia in relief. After the plate is stamped, it is subjected to an anodic oxidizing treatment, and simultaneously, it undergoes a coloring treatment. The raised indicia are then polished until the oxide coating covering them is eliminated. Finally, a metallic coating of a different appearance than the background of the dial is deposited on the indicia.

Although this and other stamping methods yield satisfactory results for metallic dials, which are sufficiently rigid to permit stamping, these stamping methods are unavailable for electroluminescent (EL) dials, such as those utilized in analog timepieces, because EL dials are either flexible or use glass. Thus, it is one object of the present invention to provide EL timepiece dials having three-dimensional indicia and the method of making the same.

It is another object of the present invention to provide EL timepiece dials having three-dimensional indicia and the method of making the same, where the indicia may be of any predetermined configuration.

Yet another object of the present invention is to provide EL timepiece dials having three-dimensional indicia and the method of making the same, where the indicia may be processed to achieve the aesthetic qualities desired.

SUMMARY OF THE INVENTION

Briefly stated, this invention relates to a method of manufacturing electroluminescent timepiece dials having three-dimensional indicia and to timepiece dials produced by this method. More specifically, the present invention concerns manufacture of an electroluminescent timepiece dial having three-dimensional indicia, the electroluminescent dial comprising a transparent substrate and at least two conductive layers sandwiching an electroluminescent layer and an insulating layer, which comprises the steps of providing a subdial having indicia of predetermined configuration, the indicia being of a first height and projecting from the subdial, providing the electroluminescent dial with apertures of a second height for receiving the indicia, the apertures and the indicia adapted to mate such that there is no electrical conduction between the indicia and the conductive layers of the electroluminescent dial, and mounting the electroluminescent dial on the subdial such that the indicia are received by the apertures.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
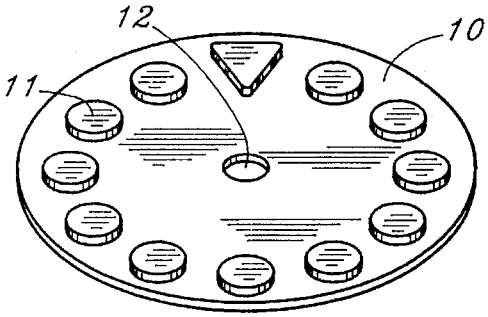
FIG. 1 is a perspective view of a subdial of the present invention showing indicia projecting from the subdial face.

FIG. 1 shows a subdial 10 having raised indicia 11. The raised indicia 11, which are preferably produced by well known embossing techniques, may also be the result of attaching the indicia 11 to the subdial 10. An opening 12 is located at the center of the subdial 10 to receive one or more rotatable stems (not shown) adapted to receive time-indicating hands (not shown). The subdial 10 may be made from either electrically conductive material, such as brass, or nonconductive material; however, for embossing, the selected material must be rigid enough to permit stamping to produce indicia 11 in relief.

Figure 2:
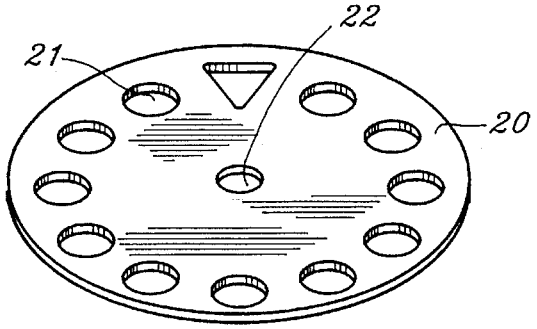
FIG. 2 is a perspective view of the face of an electroluminescent dial of the present invention showing apertures in the electroluminescent dial.

FIG. 2 illustrates an electroluminescent (EL) dial 20. The EL dial 20 has apertures 21 corresponding to the raised indicia 11 of the subdial 10. Thus, when the EL dial 20 is placed over the subdial 10, the indicia 11 and corresponding apertures 21 mate as shown in cross section in FIG. 3 or FIG. 5. A hole 22 is located at the center of the EL dial 20 to receive one or more rotatable stems (not shown) adapted to receive time-indicating hands (not shown). Note that the center opening 12 and the center hole 22 are in alignment when the EL dial 20 is positioned on top of the subdial 10.

Figure 3:
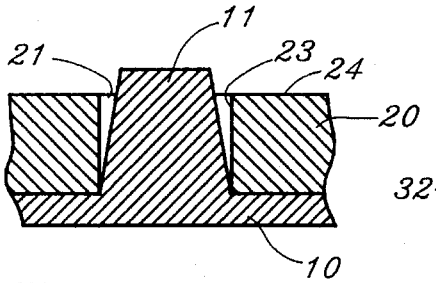
FIG. 3 is a cross section of the preferred embodiment of the present invention showing one of the indicia of the subdial extending through and beyond a corresponding aperture of the electroluminescent dial.
Figure 5:
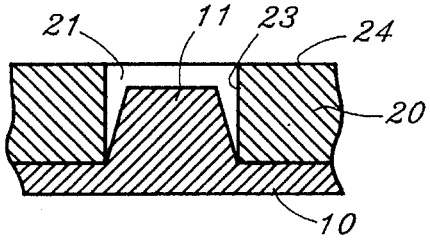
FIG. 5 is a cross section of an alternate embodiment of the present invention showing one of the indicia of the subdial extending partially into a corresponding aperture of the electroluminescent dial.

FIGS. 3 and 5 illustrate two embodiments of three-dimensional indicia for the present invention. In the preferred embodiment of FIG. 3, the desired three-dimensional effect is created by placing the EL dial 20 over the subdial 10 and having the raised indicia 11 extend through and beyond the corresponding apertures 21. Where the indicia 11 are composed of a conductive material, care must be exercised to ensure that the indicia 11 do not come into electrical contact with conductive layers of the EL dial 20. The reason for this is as follows.

Figure 4:
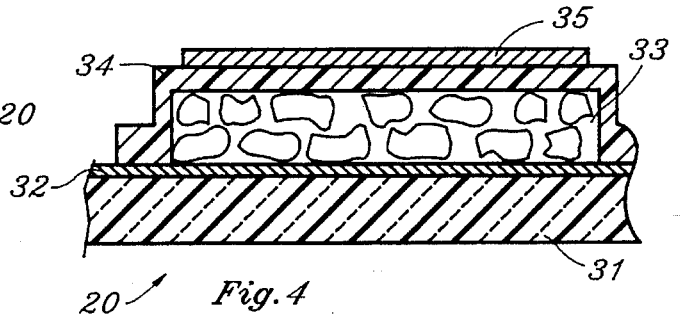
FIG. 4 is an enlarged side elevational view in cross section of an archetypal EL dial.

As is well known in the art, electroluminescent dials are generally constructed as shown in FIG. 4. FIG. 4 illustrates a side elevational view in cross section of an archetypal EL dial. The drawing is not to scale, and the layers are greatly enlarged for purposes of illustration, it being understood that some of the layers referred to herein are quite thin. The EL dial 20 would therefore typically comprise a transparent substrate 31 having deposited thereon a first conductive layer 32. Note that the transparent substrate 31 serves as the face 24 of the EL dial 20. Commercially, the substrate 31 with the conductive layer 32 already on it is available in the form of Mylar™ (a registered trademark of E. I. duPont de Nemours & Co.) having an indium tin oxide (ITO) coating. On the first conductive layer 32, an electroluminescent, layer 33 is deposited. The electroluminescent layer 33, as known, comprises electroluminescent particles such as ZnS:Cu which are thoroughly mixed in a polymerizable resin. On the electroluminescent layer 33, an insulating layer 34 is deposited. The insulating layer 34 may be composed of barium titanate or other appropriate dielectrics. Finally, a second conductive layer 35 is deposited on the insulating layer 34. The insulating layer 34 serves to maintain an electrical separation between the first and second conductive layers 32, 35.

The electroluminescent dial 20 functions by application of an electrical potential to the first and second conductive layers 32, 35. If indicia 11 composed of conductive material made electrical contact with the conductive layers 32, 35 of the EL dial 20, a short circuit would result. Therefore, to prevent a short circuit, electrical separation must be maintained between the conductive layers 32, 35 of the EL dial 20 and the indicia 11 extending through and beyond the apertures 21. In FIG. 3, the necessary electrical separation is achieved by spacing the indicia 11 from edges 23 of the apertures 21. Electrical separation between the conductive layers 32, 35 and the indicia 11 may also be achieved by coating the outer surface of the indicia 11 composed of conductive material with an insulating material, or by coating the edges 23 of the apertures 21 with an insulating material.

Note that the indicia 11 of FIG. 3 may be processed, such as by diamond polishing and plating with gold, so that the indicia 11 possess the aesthetic qualities desired. The processing of the indicia 11 may take place prior to or subsequent to mounting the EL dial 20 on the subdial 10. The preferred manner of mounting the EL dial 20 on the subdial 10 is with the use of adhesives.

An alternative method of creating the desired three-dimensional effect is illustrated in FIG. 5. In this embodiment, the indicia 11 extend only partially into the corresponding apertures 21 of the EL dial 20. Thus, three-dimensional effect is produced by the height differential between the indicia 11 and the face 24 of the EL dial 20. As is the case with the preferred embodiment of FIG. 3, where the indicia 11 are composed of a conductive material, it must be made certain that the indicia 11 do not come into electrical contact with the conductive layers 32, 35 of the EL dial 20.

Figure 6:
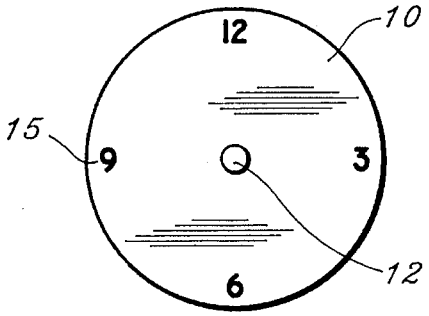
FIG. 6 is a top view of a subdial having different shaped indicia than that displayed in FIG. 1.

FIG. 6 shows a top view of the subdial 10 having different shaped indicia 15 than that displayed in FIG. 1. Likewise, the EL dial 20 would have apertures corresponding to the different shaped indicia 15. Note that the shape of the indicia may take numerous other forms.

While there has been described what is considered the preferred embodiment of the invention and a modification thereof, other modifications of the present invention will occur to those skilled in the art, and it is desired to secure in the appended claims all such modifications as fall within the true spirit and scope of the invention.

We claim:

1. A method of manufacturing an electroluminescent timepiece dial having three-dimensional indicia, the electroluminescent dial comprising a transparent substrate and at least two conductive layers sandwiching an electroluminescent layer and an insulating layer, which comprises the steps of:

providing a subdial having indicia of predetermined configuration, the indicia being of a first height and projecting from the subdial;

providing the electroluminescent dial with apertures of a second height for receiving the indicia, the apertures and the indicia adapted to mate such that there is no electrical conduction between the indicia and the conductive layers of the electroluminescent dial; and mounting the electroluminescent dial on the subdial such that the indicia are received by the apertures.

2. The method according to claim 1, wherein the subdial and the electroluminescent dial each has an opening which is substantially centered for receiving a rotatable stem adapted to receive at least one time-indicating hand of an analog timepiece.

3. The method according to claim 1, wherein the indicia are treated to a polishing operation.

4. The method according to claim 1, wherein the first height is greater than the second height.

5. A method of manufacturing an electroluminescent dial for an analog timepiece such that the electroluminescent dial has three-dimensional indicia, the electroluminescent dial comprising a transparent substrate and at least two conductive layers sandwiching an electroluminescent layer and an insulating layer, which comprises the steps of:

providing a subdial and causing the subdial to undergo an embossing operation for forming indicia in relief of predetermined configuration, the indicia being of a first height;

providing the electroluminescent dial with apertures of a second height for receiving the indicia, the apertures and the indicia adapted to mate such that there is no electrical conduction between the indicia and the conductive layers of the electroluminescent dial;

providing the subdial and the electroluminescent dial each with an opening which is substantially centered for receiving a rotatable stem adapted to receive at least one time-indicating hand of the analog timepiece; and mounting the electroluminescent dial on the subdial such that the indicia are received by the apertures.

6. The method according to claim 5, wherein the indicia are treated to a polishing operation.

7. The method according to claim 5, wherein the first height is greater than the second height.

8. A timepiece dial prepared in accordance with the method of claim 1.

9. A timepiece dial prepared in accordance with the method of claim 5.

* * * * *